US007873291B2

(12) United States Patent
Kosuge et al.

(10) Patent No.: US 7,873,291 B2
(45) Date of Patent: Jan. 18, 2011

(54) IMAGE FORMING APPARATUS AND PROCESS CARTRIDGE INCLUDING CHARGING BIAS ADJUSTMENT CONTROL

(75) Inventors: Akio Kosuge, Yokohama (JP); Takaya Muraishi, Kawasaki (JP); Takeshi Shintani, Kawasaki (JP); Yasushi Akiba, Yokohama (JP); Satoshi Hatori, Yokohama (JP); Kaoru Yoshino, Tokyo-to (JP)

(73) Assignee: Ricoh Company Limited, Tokyo (JP)

( * ) Notice: Subject to any disclaimer, the term of this patent is extended or adjusted under 35 U.S.C. 154(b) by 231 days.

(21) Appl. No.: 12/134,701

(22) Filed: Jun. 6, 2008

(65) Prior Publication Data

US 2008/0304843 A1 Dec. 11, 2008

(30) Foreign Application Priority Data

Jun. 8, 2007 (JP) ..... 2007-152260

(51) Int. Cl.
*G03G 15/02* (2006.01)
*G03G 15/00* (2006.01)

(52) U.S. Cl. ..... 399/50; 399/44

(58) Field of Classification Search ..... 399/38, 399/44, 50, 85
See application file for complete search history.

(56) References Cited

U.S. PATENT DOCUMENTS 5,420,671 A * 5/1995 Kisu et al. ..... 399/50 X
5,717,979 A * 2/1998 Senba et al. ..... 399/50
6,088,551 A 7/2000 Satoh et al.
6,628,912 B2 9/2003 Amemiya et al.
6,961,529 B2 11/2005 Kosuge
6,990,305 B2 1/2006 Kosuge et al.
7,024,125 B2 * 4/2006 Ishii et al. ..... 399/50
7,113,727 B2 9/2006 Kosuge et al.
7,139,504 B2 11/2006 Yanagida et al.
7,155,146 B2 12/2006 Kosuge et al.
7,218,877 B2 5/2007 Yanagida et al.
7,266,324 B2 9/2007 Yanagida et al.
7,302,197 B2 11/2007 Kosuge
7,340,200 B2 3/2008 Kosuge
7,634,206 B2 * 12/2009 Hagiwara et al. ..... 399/44

(Continued)

FOREIGN PATENT DOCUMENTS

JP 2001-201921 7/2001

(Continued)

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus includes an image bearing member, a charging device to apply a charging bias, a developing device to develop a latent electrostatic image with toner, a transfer device to transfer the toner image to a recording medium, a fixing device to fix the toner image on the recording medium, an image formation speed switching device to switch from one image formation speed to another speed, a storage device to store a charging current target of the charging bias for each image formation speed, an electric current detection device to detect electric current flown through the charging device, and an AC voltage adjustment device to adjust AC voltage of the charging bias applied to the charging device. The charging current target is set for each of at least two image formation speeds such that each AC voltage adjusted by the AC voltage adjustment device is substantially the same.

20 Claims, 4 Drawing Sheets

U.S. PATENT DOCUMENTS

| | | | | |
|---|---|---|---|---|
| 2002/0102108 | A1 | 8/2002 | Adachi et al. | |
| 2003/0219268 | A1 | 11/2003 | Sunahara et al. | |
| 2005/0025520 | A1 | 2/2005 | Murakami et al. | |
| 2005/0042000 | A1 | 2/2005 | Sato | |
| 2005/0175374 | A1* | 8/2005 | Kosuge | 399/168 |
| 2005/0191081 | A1 | 9/2005 | Muraishi et al. | |
| 2005/0271420 | A1 | 12/2005 | Arai et al. | |
| 2006/0078353 | A1 | 4/2006 | Kosuge et al. | |
| 2007/0081835 | A1 | 4/2007 | Tsuda et al. | |
| 2007/0104513 | A1 | 5/2007 | Kosuge et al. | |
| 2007/0196123 | A1 | 8/2007 | Mizuishi et al. | |
| 2008/0013986 | A1 | 1/2008 | Kosuge | |
| 2008/0031646 | A1 | 2/2008 | Ishibashi et al. | |
| 2008/0069615 | A1 | 3/2008 | Shintani et al. | |

FOREIGN PATENT DOCUMENTS

| | | |
|---|---|---|
| JP | 2005-300604 | 10/2005 |
| JP | 2006-106564 | 4/2006 |

* cited by examiner

IMAGE FORMING APPARATUS AND PROCESS CARTRIDGE INCLUDING CHARGING BIAS ADJUSTMENT CONTROL

BACKGROUND OF THE INVENTION

1. Field of the Invention

The present invention relates to an image forming apparatus and a process cartridge.

2. Discussion of the Background

As an image forming apparatus including a charging device to uniformly charge the surface of an image bearing member by applying a charging bias in which an AC voltage is overlapped with a DC voltage to a charging member provided facing the surface of the image bearing member, there is known an image forming apparatus in which a charging member such as a charging roller formed of a material having an electric resistance to which a charging bias is applied is provided in contact with or in the vicinity of the surface of the image bearing member.

As a system of applying a charging bias to a charging member, there are known a DC application system which applies a charging bias only composed of DC voltage component and an AC application system in which an AC voltage is overlapped with a DC voltage for application of a charging bias. In either of the systems, the optimal charging bias required to obtain a desired surface voltage for the image bearing member varies depending on changes in the charging conditions, such as environmental change such as temperature and humidity, and change in the contact state or the distance (gap) between the surface of an image bearing member and the charging member. For example, when the temperature of a charging member falls, the resistance thereof increases, and when the temperature of a charging member rises, the resistance thereof decreases. Therefore, in a low temperature environment, since the resistance of the charging member is high, discharging required for charging treatment tends to hardly occur. Thus, the surface of the image bearing member is not charged up to the target charging voltage, which tends to lead to insufficient charging.

By contrast, in a high temperature environment, since the resistance of the charging member is low, excessive discharging tends to occur. This easily leads to deterioration of the surface of the image bearing member or the occurrence of filming in which toner or external additives thereto fixates on the surface of the image bearing member. Therefore, as the temperature changes, it is desirable that the DC voltage of the charging bias be adjusted in the DC application system and the AC voltage (Vpp: peak to peak voltage) of the charging bias be adjusted in the AC application system such that the charging bias applied to the charging member is optimized for the temperature at the time.

In addition, the amount of discharging in the AC application system is relatively large in comparison with that in the DC application system. Therefore, it is desirable that the AC voltage of the charging bias be as low as possible to avoid the occurrence of filming. At the same time, however, an AC voltage of the charging bias that is too low tends to lead to insufficient discharging, resulting in the occurrence of bad charging. Therefore, when the temperature rises and the resistance of the charging member declines, the AC voltage is reduced to avoid excessive discharging. On the other hand, when the temperature falls, the AC voltage is increased. Thereby, the AC voltage of the charging bias is controlled to maintain the optimal value.

Unexamined published Japanese patent application No. 2001-201921 describes a charging bias control method for the AC application system. In this control method, the AC electric current when the peak to peak voltage Vpp less than twice Vth is applied to at one or more points of the image bearing member and the AC electric current when the peak to peak voltage Vpp less than twice Vth is applied to at two or more points of the image bearing member are measured, where Vth represents the discharging starting voltage to an image bearing member when a DC voltage is applied to a charging member. Then, based on these measured values, the peak to peak voltage Vpp of the AC voltage to be applied to a charging member is adjusted at the next image formation.

According to the description in unexamined published Japanese patent application No. 2001-201921, it is possible to maintain the optimal AC voltage which secures sufficient discharging without causing excessive discharging even when the resistance of the charging member changes according to environmental changes such as a temperature change.

In addition to the method described in unexamined published Japanese patent application No. 2001-201921, there is another method of adjusting a charging bias which can maintain the most suitable voltage at which sufficient discharging is secured without causing excessive discharging even when the resistance of the charging member changes according to the environmental change such as a temperature change. Specifically, the method involves controlling a constant electric current such that the AC electric current (effective value) flowing through a charging member matches a target value (charging electric current target). When the temperature rises and the resistance of the charging member declines, the electric current flowing through the charging member surpasses the target value, and accordingly, the AC electric current is controlled to decrease. When the temperature falls and the resistance of the charging member increases, the electric current flowing through the charging member falls below the target value, in which, the AC electric current is controlled to increase. Therefore, when the resistance of the charging member varies according to the environment change such as temperature change, it is possible to maintain the optimal AC voltage which secures sufficient discharging without causing excessive discharging.

On the other hand, there is an image forming apparatus which forms images on various kinds of recording media with different definitions by switching the image formation speed. When the image formation speed is different, the surface travel speed of an image bearing member is different, and naturally, the time to be taken for the surface portion on the image bearing member per unit area to pass through the charging area of the charging device varies. Therefore, when an AC application system is adopted and the image formation speed is high, it is known that the AC voltage frequency of the charging bias is short, which causes striped uneven density according to the frequency. In addition, when an AC application system is adopted and the image formation speed is low, it is also known that the AC voltage frequency of the charging bias is high, which easily causes filming on the surface of the image bearing member. Therefore, in an image forming apparatus which forms images by switching image formation speeds, it is desired to change the AC voltage frequency of the charging bias to a frequency suitable for the image formation speed every time the image formation speed is switched.

In general, when images are continuously formed by an image forming apparatus, the temperature therein rises. When there is a long interval between successive image formations, the temperature in the image forming apparatus declines, meaning that the temperature changes second by second. Since the optimal AC voltage varies according to the changes in the temperature in the image forming apparatus, it is desirable to increase the frequency of charging bias adjustment. However, depending on the status of use of an image forming apparatus, increasing the frequency of charging bias adjustment may result in significant extension of the waiting time for a user, for the reason described below.

Specifically, when a large number of images are continuously formed, it is desirable to adjust the charging bias in the middle of the continuous image formation. In a typical image forming apparatus which can switch image formation speeds, the charging bias is adjusted to maintain the optimal AC voltage by a single image formation speed (a particular image formation speed). Therefore, for example, a user who continuously forms images in a large number at a speed different from the particular image formation speed changes the image formation speed for charging bias adjustment during the particular image formation speed on every occasion, resulting in extension of the time to be taken for adjusting the charging bias. Images are not formed while the charging bias is adjusted, and thus, the time to be taken for adjusting the charging bias is tantamount to waiting time for the user. Therefore, in this case, the time to be taken for changing the image formation speed results in an increase in the waiting time for the user.

SUMMARY OF THE INVENTION

For these reasons, the present inventors recognize that a need exists for an image forming apparatus and a process cartridge which shorten the adjustment time for the charging bias in the image forming apparatus which forms images by switching image formation speeds.

Accordingly, an object of the present invention is to provide an image forming apparatus and a process cartridge which shorten the adjustment time for the charging bias in the image forming apparatus which forms images by switching image formation speeds.

Briefly this object and other objects of the present invention as hereinafter described will become more readily apparent and can be attained, either individually or in combination thereof, by an image forming apparatus including an image bearing member with a moving surface which travels, a charging device including a charging member located facing the moving surface of the image bearing member which uniformly charges the moving surface of the image bearing member to form a latent electrostatic image thereon by applying a charging bias in which an AC voltage is overlapped with a DC voltage to the charging member, a developing device to develop the latent electrostatic image with toner to form a toner image on the moving surface of the image bearing member, a transfer device to transfer the toner image on the moving surface of the image bearing member to a recording medium, a fixing device to fix the toner image on the recording medium, an image formation speed switching device to switch from one image formation speed to another image formation speed among multiple image formation speeds by changing the moving surface traveling speed of the image bearing member according to a particular switching condition, a storage device to store a charging current target of the charging bias applied to the charging member for each of the multiple image formation speeds, an electric current detection device to detect an electric current flown through the charging member and an AC voltage adjustment device to adjust an AC voltage of the charging bias applied to the charging member such that the electric current detected by the electric current detection device approaches the charging current target stored at the storage device which corresponds to the image formation speed when the electric current is detected. With regard to at least two image formation speeds among the multiple image speeds, the charging current target is set for each of the at least two image formation speeds such that each AC voltage adjusted by the AC voltage adjustment device is substantially the same.

It is preferred that, in the image forming apparatus, the electric current detection device detects an electric current flowing through the charging member during image formation, and the AC voltage adjustment device adjusts an AC voltage of the charging bias applied to the charging member during image formation.

It is still further preferred that, in the image forming apparatus, an AC voltage frequency f (Hz) of the charging bias and the image formation speed V (mm/s) satisfy the following relationship: $6<f/V<9$.

It is still further preferred that the image forming apparatus further includes an environment information detection device to detect environment information inside or around the image forming apparatus and wherein the storage device stores multiple charging current targets corresponding to multiple pieces of environment information for each of the multiple image formation speeds, the AC voltage adjustment device adjusts the AC voltage of the charging bias applied to the charging member such that the electric current detected by the electric current detection device approaches the charging current target which corresponds to the environment information detected by the environment information detection device among multiple charging current targets which correspond to the image formation speed when the electric current is detected.

It is still further preferred that, in the image forming apparatus, the image bearing member is an organic photoreceptor including a protective layer on the moving surface thereof.

It is still further preferred that the image forming apparatus further includes a lubricant supply device configured to supply a lubricant to the moving surface of the image bearing member.

As another aspect of the present invention, a method of forming images is provided which includes charging a moving surface of an image bearing member with a charging device including a charging member located facing the moving surface of the image bearing member, the charging device uniformly charging the moving surface of the image bearing member to form a latent electrostatic image thereon by applying a charging bias in which an AC voltage is overlapped with a DC voltage to the charging member, irradiating the moving surface of the image bearing member to form a latent electrostatic image thereon, developing the latent electrostatic image with toner to form a toner image on the moving surface of the image bearing member with a developing device, transferring the toner image on the moving surface of the image bearing member to a recording medium with a transfer device, fixing the toner image on the recording medium with a fixing device, switching from one image formation speed to another image formation speed among multiple image formation speeds by changing a surface traveling speed of the image bearing member according to a particular switching condition with an image formation speed switching device, storing a charging current target of the charging bias applied to the charging member for each of the multiple image formation speeds by a storage device; detecting an electric current flown through the charging member with an electric current detection device and adjusting an AC voltage of the charging bias applied to the charging member with an AC voltage adjustment device such that the electric current detected by the electric current detection device approaches the charging current target stored at the storage device which corresponds to the image formation speed when the electric current is detected. With regard to at least two image formation speeds among the multiple image speeds, the charging current target is set for each of the at least two image formation speeds such that each AC voltage adjusted by the AC voltage adjustment device is substantially the same.

It is preferred that, in the method of forming images, the electric current detection device detects an electric current flowing in the charging member during image formation, and the AC voltage adjustment device adjusts an AC voltage of the charging bias applied to the charging member during image formation.

It is still further preferred that, in the method of forming images, an AC voltage frequency f (Hz) of the charging bias and the image formation speed V (mm/s) satisfy the following relationship: $6<f/V<9$.

It is still further preferred that, in the method of forming images, further including detecting environment information inside or around the image forming apparatus with an environment information detection device. Furthermore, the storage device stores multiple charging current targets corresponding to multiple pieces of environment information for each of the multiple image formation speeds, and the AC voltage adjustment device adjusts the AC voltage of the charging bias applied to the charging member such that the electric current detected by the electric current detection device approaches the charging current target which corresponds to the environment information detected by the environment information detection device among multiple charging current targets which correspond to the image formation speed when the electric current is detected.

It is still further preferred that, in the method of forming images, the charging member has a roller form and is located in the vicinity of the moving surface of the image bearing member.

It is still further preferred that, in the method of forming images, the charging member includes an electroconductive supporting member, an electroconductive resin portion which covers a portion of the electroconductive supporting member which faces the moving surface of the image bearing member, and an insulation resin portion which contacts the moving surface of the image bearing member to maintain a gap between the moving surface of the image bearing member and the electroconductive resin portion.

It is still further preferred that, in the method of forming images, the image bearing member is an organic photoreceptor comprising a protective layer on the moving surface thereof.

It is still further preferred that the method of forming images further includes supplying a lubricant to the moving surface of the image bearing member with a lubricant supply device.

As another aspect of the present invention, a process cartridge is provided detachably attachable to the main body of the image forming apparatus, which includes the image bearing member mentioned above, the charging device mentioned above and the storage device mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
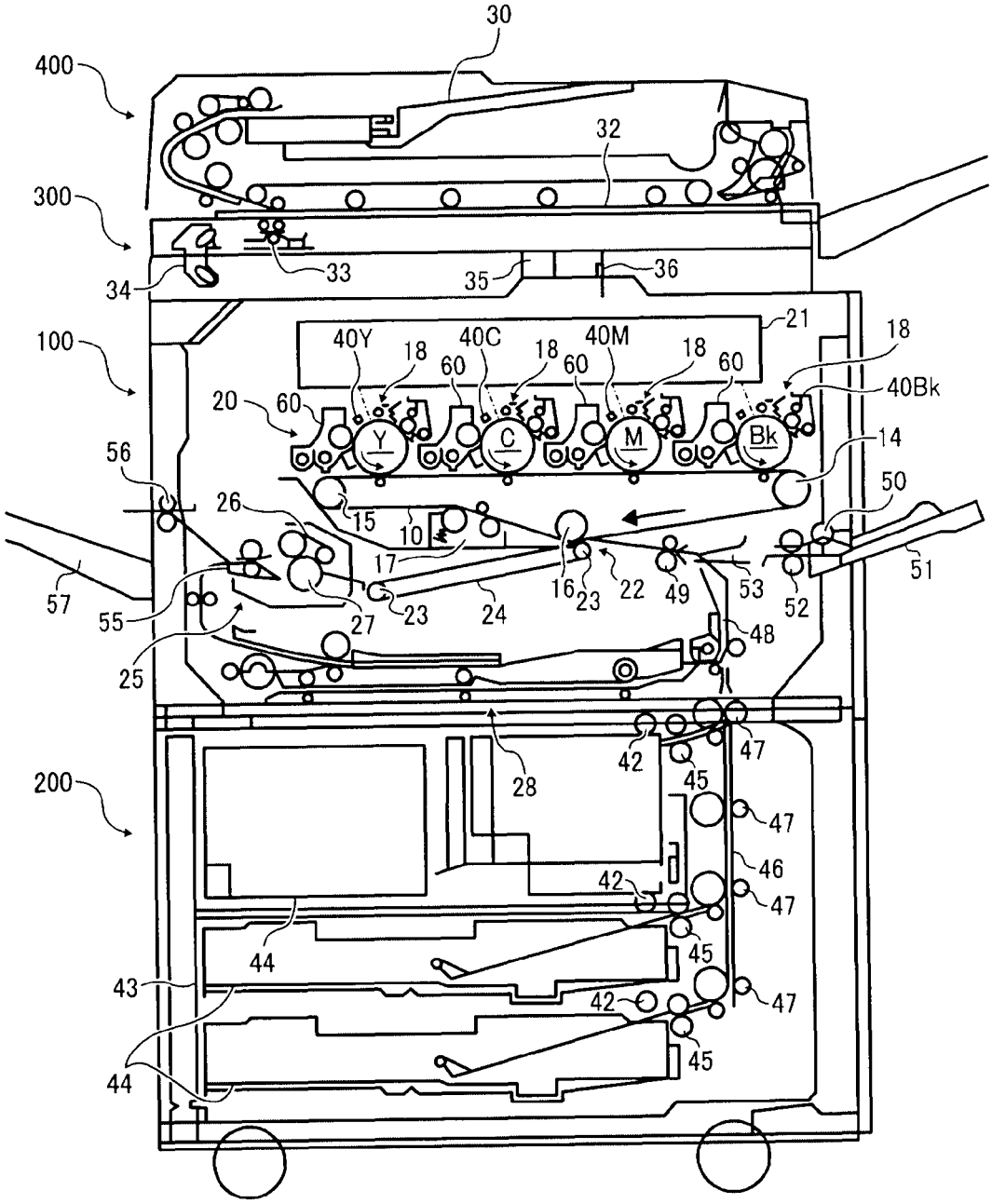
FIG. 1 is a diagram illustrating a schematic diagram illustrating an example of the photocopier in relation with the embodiment described later.

FIG. 1 is a schematic diagram illustrating the structure of an example of the photocopier functioning as the image forming apparatus to which the present application is applied.

In FIG. 1, a reference numeral 100 represents the main body of the photocopier and the numeral reference 200 represents a paper feeder table holding the main body 100, a numeral reference 300 represents a scanner attached to the main body 100 and a numeral reference 400 is an automatic document handler (ADF) attached to the scanner 300. This photocopier is a tandem type and an electrophotographic photocopier adopting an intermediate transfer (indirect transfer) system.

The main body 100 includes an intermediate transfer belt 10 including an intermediate transfer body at the center thereof. The intermediate transfer belt 10 rotates clockwise in FIG. 1 while suspended over first, second and third supporting rollers 14, 15 and 16 as three supporting rotation bodies. The intermediate transfer belt 10 is formed by molding a resin material such as polyvinylidene fluoride, polyimide, polycarbonate and polyethylene terephthalate on a seamless belt. These materials are used as they are and an electroconductive material such as carbon black can be added to adjust the electric resistance thereof. In addition, the layer formed of these resins is used as a substrate layer and a surface layer can be accumulated thereon by a spraying method or a dipping method.

An intermediate transfer belt cleaner 17 is provided to the belt portion stretched between the second roller 15 and the third roller 16 among the three supporting rollers to remove toner remaining on the intermediate transfer belt 10 after image transfer. In addition, a tandem image formation portion 20 in which four image formation units 18 of yellow (Y), cyan (C), magenta (M) and black (K) are arranged along the belt travel direction is provided facing the intermediate transfer belt 10 to the belt portion stretched between the first roller 14 and the second roller 15 among the three supporting rollers. In this embodiment, the third supporting roller 16 is a driving roller. Above the tandem image formation portion 20, there is provided an irradiation device 21 as a latent electrostatic image formation device forming a toner image formation device.

The irradiation device 21 has four light sources of a laser diode system prepared for each color, a pair of polygon scanners including a hexagonal polygon mirror and a polygon motor, and lenses and mirrors such as an fθ lens and a wide toroidal lens located in the light paths for each light source. According to image information of each color, the laser light emitted from a laser diode is deflected by the polygon scanner and scans the moving surface (hereinafter referred to as surface) photoreceptor drums 40Y, 40C, 40M and 40K as image bearing members in the image formation unit 18 for each color.

In addition, a secondary transfer device 22 is provided on the opposite side of the tandem image formation portion with the intermediate transfer belt 10 therebetween. In the secondary transfer belt 22, a secondary transfer belt 24 as a recording medium transfer device is suspended over two rollers 23. The secondary transfer belt 24 is pressed against the third supporting roller 16 with the intermediate transfer belt 10 therebetween. The image on the intermediate transfer belt 10 is transferred to a sheet (recording medium) by way of the secondary transfer belt 22. In addition, a fixing device 25 to fix the image transferred onto the sheet is provided on the left hand side of the secondary transfer device 22. The fixing device 25 has a structure in which a pressing roller 27 is pressed against a fixing belt 26. The secondary transfer device 22 transfers the sheet immediately after image transfer to the fixing device 25. A transfer roller or a non-contact type charger can be used as the secondary transfer device 22 although it is difficult for such a roller or a charger to have this sheet transfer function. In addition, under the secondary transfer device 22 and the fixing device 25, a sheet reverse device 28 which reverses the sheet is provided in parallel to the tandem image formation portion 20 to record images on both sides of the sheet.

Next, the image formation units 18 in the tandem image formation portion 20 are described.

Figure 2:
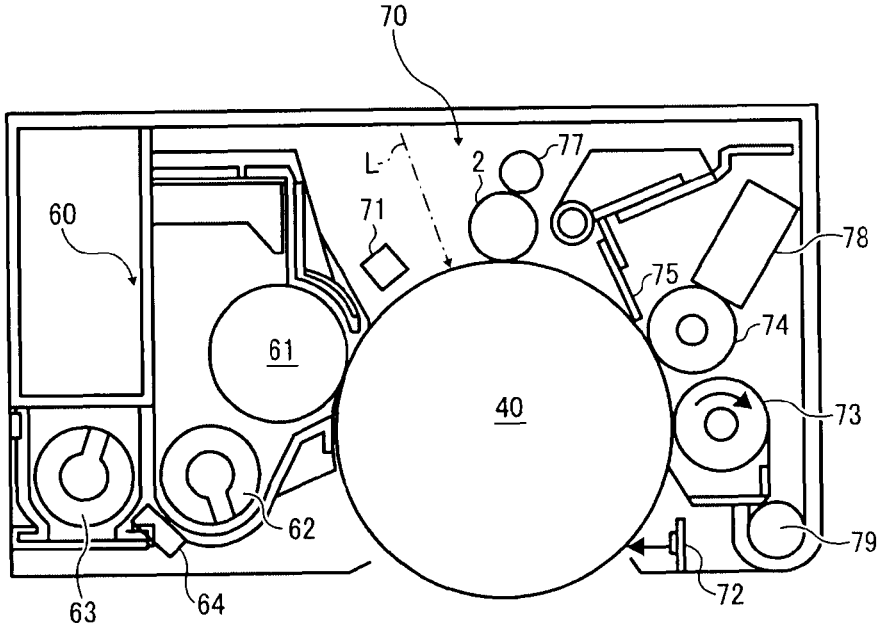
FIG. 2 is a schematic diagram illustrating one of the image formation units provided to the tandem image formation portion of the photocopier.

FIG. 2 is a schematic diagram illustrating the structure of one of the image formation units 18.

Since the four image formation units 18 are the same in light of the structure thereof, only one image formation unit 18 is described.

Around the photoreceptor drum 40, there are provided the following devices: a charging roller 2 as a charging member forming a charging device 70 which uniformly charges the surface of the photoreceptor drum 40; a voltage sensor 71 to detect the voltage of the photoreceptor drum 40; a developing device 60 to develop a latent electrostatic image formed on the surface of the photoreceptor drum 40 by the irradiation device 21 with toner; a discharging lamp 72 to discharge the surface of the photoreceptor drum 40 after the toner image is transferred; and a cleaning device formed of two brush rollers 73 and 74 and a cleaning blade 75 made of urethane rubber to remove residual toner remaining on the surface of the photoreceptor drum 40 after the toner image is transferred. In addition, the case of the image formation unit 18 has an opening to pass the irradiation light L from the irradiation device 21. Furthermore, a cleaning roller 77 is provided in contact with the charging roller 2 to clean the surface thereof. A brush roller or a sponge roller formed on a core metal is used as the cleaning roller 77. The cleaning roller 77 is in contact with the charging roller 2 on its own weight and removes the dirt such as toner adhered to the surface of the charging roller 2 while rotationary driven by the rotation of the charging roller 2.

The developing device 60 includes a developing roller 61 as a developing agent (toner) bearing member facing the surface of the photoreceptor 40, screws 62 and 63 to stir and transfer the developing agent, a toner density sensor 64 to detect the toner density, etc. The developing roller 61 includes a rotatable sleeve and a magnet fixed therein. Toner is replenished by a toner supplier (not shown) based on the output of the toner density sensor 64.

The toner is mainly made of a binder resin, a coloring agent and a charge control agent. Other additives are added, if desired.

Specific examples of such resins include polystyrene, an ester copolymer of styrene acrylate, a polyester resin, etc.

As the coloring agent (for example, yellow, cyan, magenta and black) for use in the toner, known coloring agents for toner can be used. It is preferred to add such a coloring agent in an amount of from 0.1 to 15 parts by weight based on 100 parts of the binder resin.

Specific examples of the charge control agents include nigrosine dye, chromium containing complex, quaternary ammonium salt, etc. These are selected depending on the polarity of toner particles. It is preferred to add such a charge control agent in an amount of from 0.1 to 10 parts by weight based on 100 parts of the binder resin.

It is desired to add a fluidizer to toner particles. Specific examples thereof include particulates of metal oxides such as silica, titania, alumina, the particulates which are subject to treatment by a silane coupling agent, titanate coupling agent, etc., and polymer particulates such as polystyrene, polymethyl methacrylate, polyvinilydene fluoride. The particle diameter of such a fluidizer is suitably from 0.01 to 3 μm. The addition amount of the fluidizer is preferably in an amount of from 0.1 to 7.0 parts by weight based on 100 parts of the binder resin.

As a method of manufacturing a two component developing agent, any known method and a combination thereof can be used. For example, in a mixing, kneading and pulverizing method, a binder resin, a coloring agent such as carbon black, other desired additives are mixed in a dry manner followed by heating, melting and kneading the resultant by an extruder, two rollers, or three rollers. Subsequent to cooling down and hardening, the mixture is pulverized by a pulverizer such as a jet mill and classified by an air classifier to obtain a toner. It is also possible to directly manufacture a toner from a monomer, a coloring agent and an additive by a suspension polymerization method or a non-aqueous dispersion polymerization method. As a carrier contained in a two component developing agent, just a core material or a substance in which a cover layer is coated on a core material is typically used.

Ferrite or magnetite is used as the core material of a resin coated carrier in this embodiment. The core material has suitably a particle diameter of from about 20 to about 60 μm.

Specific examples of the material for use in forming a coating layer of a carrier include vinylidene fluoride, tetrafluoroethylene, hexafluoropropylene, perfluoroalkyl vinyl ether, vinyl ether formed by substitution of a fluorine atom, vinyl ketone formed by substitution of a fluorine atom, etc. As to the method of manufacturing a coating layer, it is suitable to use a spraying method, dipping method to apply the binder resin to the surface of carrier core material particle.

A one component developing agent can be also used instead of a two-component developing agent.

A laminate type organic photoreceptor in which a photoreceptive layer including a charge generation layer and a charge transport layer is formed on an electroconductive substrate is used as the image bearing member for use in this embodiment.

Materials having a volume resistance of not greater than $10^{10}$ Ωcm can be used for the electroconductive substrate. For example, there can be used plastic or paper having a film form or hollow cylindrical form covered with a metal such as aluminum, nickel, chrome, nichrome, copper, gold, silver, and platinum, or a metal oxide such as tin oxide and indium oxide by depositing or sputtering. Further, a tube material of aluminum, an aluminum alloy, nickel, and a stainless metal which is treated by a crafting technique such as extruding and extracting and surface-treatment such as cutting, super finishing and grinding is also usable.

The charge generating layer is a layer including a charge generating material as the main component. Inorganic and organic materials are used as the charge generating material. Specific examples thereof include monoazo pigments, disazo pigments, trisazo pigments, perylene based pigments, perynone based pigments, quinacridone based pigments, quinone based condensed polycyclic compounds, squaric acid based dyes, phthalocyanine based dyes, naphthalocyanine based pigments, azulenium salt based pigments, selenium, selenium-tellurium alloy, selenium-arsenic alloy, and amorphous silicone. These kinds of charge generating material can be used alone or in combination. The charge generating layer is formed by application of a liquid application prepared by dispersing a charge generating material and an optional binder resin in a solvent such as tetrahydrofuran, cyclohexanone, dioxane or 2-butanone, dichloroethane by a dispersion device such as a ball mill, an attritor or a sand mill. The charge generating layer is applied by using a dip coating method, a spray coating method, a bead coating method, etc. Specific examples of suitable binder resins include polyamide, polyurethane, polyester, epoxy, polyketone, polycarbonate, silicone, acryl, polyvinyl butyral, polyvinyl formal, polyvinyl ketone, polystyrene, polyacryl and polyamide. The amount of such a binder resin is from 0 to 2 parts by weight based on 1 part of the charge generating material. The charge generating layer can be formed by a known vacuum thin layer manufacturing method. The layer thickness of the charge generating layer is from 0.01 to 5 μm and preferably from 0.1 to 2 μm.

The charge transport layer is formed by dissolving or dispersing a charge transport material and a binder resin in a suitable solvent, and applying the liquid dispersion or solution to the layer below the charge transport layer followed by drying. A plasticizer or a leveling agent can be added, if desired. Among the charge transport material, there are electron transport material and positive hole transport material as a low molecule charge transport material. Specific examples of such electron transport material include electron accepting materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, and 1,3,7-trinitrodibenzo thiophene-5,5-dioxide. These charge transport material can be used alone or in combination.

Specific examples of such positive hole transport materials include electron donating materials such as oxazole derivatives, oxadiazole derivatives, imidazole derivatives, triphenyl amine derivatives, 9-(p-diethylaminostyryl anthracene), 1,1-bis-(4-dibenzyl aminophenyl)propane, styryl pyrazoline, phenyl hydrazones, α-phenyl stilbene derivatives, thiazole derivatives, triazole derivatives, phenazine derivatives, acridine derivatives, benzofuran derivatives, benzimidazole derivatives and thiophene derivatives. These positive hole transport materials can be used alone or in combination.

Specific examples of the binder resins for use in the charge transport layer together with the charge transport material include thermal curing resins and thermal plastic resins such as polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarates, phenoxy resins, polycarbonates, cellulose acetate resins, ethyl cellulose resins, polyvinyl butyrals, polyvinyl formals, polyvinyl toluene, acrylic resins, silicone resins, epoxy resins, melamine resins, urethane resins, phenol resins, and alkyd resins.

Specific examples of the solvents include tetrahydrofuran, dioxane, toluene, 2-butanone, monochlorobenzene, dichloroethane, and methylene chloride. The thickness of the charge transport layer is suitably selected from 10 to 40 μm according to desired characteristics of the image bearing member. Specific examples of plasticizers, which are optionally added to the charge transport layer, include known plasticizers such as dibutyl phthalate and dioctyl phthalate. The content of the plasticizer in the charge transport layer is from 0 to about 30% by weight based on the binder resin contained in the charge transport layer. Specific examples of leveling agents, which are optionally added to the charge transport layer, include silicone oils such as dimethyl silicone oils and methyl phenyl silicone oils, and polymers and oligomers, which include a perfluoroalkyl group in their side chain. The content of the leveling agent in the charge transport layer is from 0 to about 1% by weight based on the binder resin included in the charge transport layer. In this embodiment, the content of the charge transport material contained in the photosensitive layer is preferably not less than 30% by weight based on the weight of the charge transport layer. When the content is too small, the light attenuation time tends to be not sufficiently secured in the high speed electrophotographic process for pulse light irradiation when a laser beam is written to an image bearing member, which is not preferred.

It is possible to form an undercoating layer between the electroconductive substrate and the photosensitive layer for the image bearing member in this embodiment. In general, an undercoating layer is mainly composed of a binder resin. Considering that a photosensitive layer is coated on the binder resin using a solvent, it is preferred to use a binder resin hardly soluble in a typical organic solvent. Specific examples of such binder resins include water soluble resins such as polyvinyl alcohol, caseine and sodium polyacrylate, alcohol soluble resins such as copolymerized nylon and methoxymethylated nylon and curing type resins which forms three dimensional network structure such as polyurethane, melamine, alkyd-melamine and epoxy resins. Fine powder pigments of metal oxides exemplified by titanium oxide, silica, alumina, zirconium oxide, tin oxide and indium oxide can be added to the undercoating layer to prevent the occurrence of moiré, reduce the residual voltage, etc. The undercoating layer can be formed by using the same solvents and the same coating methods as those for the photosensitive layer. It is also possible to use a metal oxide layer formed by using a silane coupling agents, a titanium coupling agent and a chromium coupling agent by a method such as a sol-gel method as the undercoating layer. In addition, $Al_2O_3$ formed by anodic oxidization, organic compounds such as polyparaxylylene (parylene) and inorganic materials such as SiO, $SnO_2$, $TiO_2$, ITO and $CeO_2$, which are formed by a vacuum thin layer manufacturing method can be also used for the undercoating layer. The thickness of the undercoating layer is suitably from 0 to 5 μm.

In addition, it is possible to form a protective layer on the photosensitive layer to protect the photosensitive layer and improve the durability thereof. Such a protective layer has a structure in which metal oxide particulates such as alumina, silica, titanium oxide, tin oxide, zirconium oxide and indium oxide are added to a binder resin to improve the abrasion resistance of the protective layer. Specific examples of the binder resins include styrene-acrylonitrile copolymers, styrene-butadiene copolymers, acrylonitrile-butadiene-styrene copolymers, olefin-vinyl monomer copolymers, chlorinated polyethers, aryl resins, phenol resins, polyacetal resins, polyamide resins, polyamideimide resins, polyacrylate resins, polyarylsulfon resins, polybutylene resins, polybutylene terephthalate resins, polycarbonate resins, polyether sulfone resins, polyethylene resins, polyethylene terephthalate resins, polyimide resins, acryl resins, polymethyl pentene resins, polypropylene resins, polyphenylene oxide resins, polysulphone resins, polyurethane resins, polyvinyl chloride resins, polyvinylidene resins and epoxy resins. The content of the metal oxide particulate to be added to the protective layer is usually from 5 to 30% by weight. When the content is too small, the abrasion amount tends to be large, meaning that the abrasion resistance is not improved. When the content is too large, the voltage at the light portion during irradiation significantly easily increases, which causes deterioration of sensitivity to an unignorable degree. When the protective layer is formed, a typical method such as a spraying method is adopted. The layer thickness of the protective layer is from 1 to 10 μm and preferably from about 3 to about 8 μm. When the thickness of the protective layer is too thin, the durability thereof is inferior. When the thickness of the protective layer is too thick, the productivity deteriorates in light of manufacturing and also the residual voltage significantly increases over time. The diameter of the metal oxide particulates to be added to the protective layer is suitably from 0.1 to 0.8 μm. When the particle diameter of metal oxide particulates is too large, the degree of roughness of the surface of the protective layer tends to be great so that the cleaning property deteriorates and thus the image quality deteriorates because the irradiation light easily scatters at the protective layer, resulting in deterioration of the definition. When the particle diameter of metal oxide particulates is too small, the abrasion resistance tends to be inferior. A dispersion helper is optionally added to the protective layer to improve the dispersion property of the metal oxide particulates to the main binder resin. A dispersion helper for a coating compound can be suitably used and the content thereof is from 0.5 to 4% and preferably from 1 to 2% based on the content of the metal oxide particulate.

In addition, transfer of the charges in the protective layer is accelerated by adding a charge transport material to the protective layer. The same material for use in the charge transport layer can be used as the charge transport material for use in the protective layer. It is desired to add an anti-oxidization agent, a plasticizer, an ultraviolet absorbent, a leveling agent, etc. to each layer to improve the environment resistance of the image bearing member for use in this embodiment, especially to prevent the deterioration in the sensitivity and the rise in the residual voltage thereof. The structure for the protective layer for use in the embodiment is not limited to the type in which metal oxide particles are dispersed, but it is also possible to use an optical or heat curing type resin material to form a protective layer. Furthermore, an inorganic image bearing member such as amorphous silicone can be used.

A solid lubricant 78 is provided in contact with the brush roller 74. The brush roller 74 and the solid lubricant 78 function as a lubricant supply device. Specific examples of the solid lubricant 78 include metal salts of aliphatic acid such as zinc stearate, barium stearate, iron stearate, nickel stearate, cobalt stearate, copper stearate, strontium stearate, calcium stearate, magnesium stearate, zinc oleate, cobalt oleate, magnesium oleate and zinc paltimate, natural wax such as carnauba wax, fluorine based resins such as polytetrafluoroethylene. The toner scraped from the photoreceptor drum 40 by the brush rollers 73 and 74 and the cleaning blade is retrieved by a toner transfer coil 79 and transferred to a waste toner container (not shown).

This embodiment adopts a structure in which the surface of the photoreceptor drum 40 is cleaned after image transfer and discharging but a structure in which the surface of the photoreceptor drum 40 is discharged after image transfer and cleaning can be also adopted.

Figure 3:
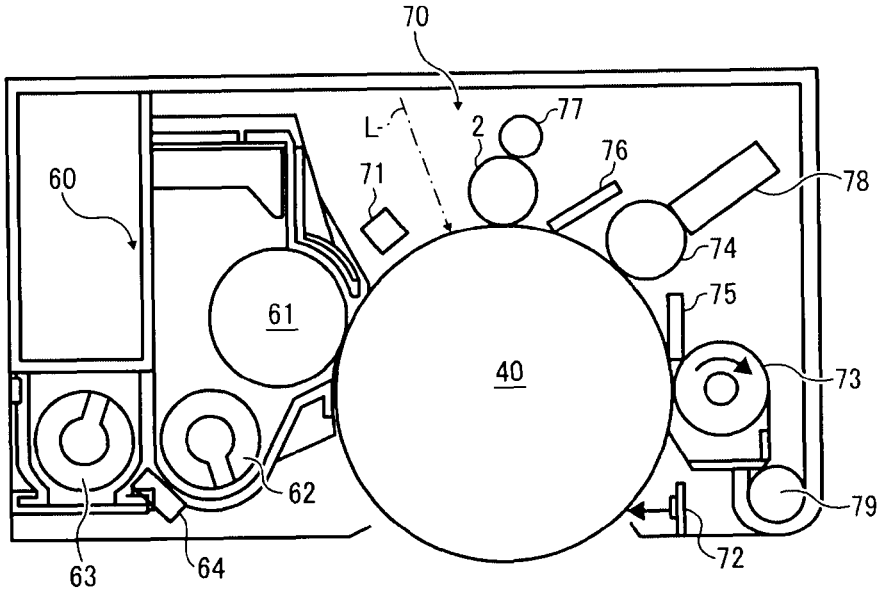
FIG. 3 is a diagram illustrating a variation of the image formation unit.

In addition, in this embodiment, the lubricant supply device is arranged on the upstream side relative to the cleaning blade 75 based on the surface travel direction of the photoreceptor drum 40. However, the supply amount of the lubricant varies depending on the amount of residual toner in this structure. Thus, as illustrated in FIG. 3, the lubricant supply device can be arranged on the downstream side relative to the cleaning blade 75 based on the surface travel direction of the photoreceptor drum 40.

When photocopying is performed using the photocopier of this embodiment, an original is set on the original table 30 of the ADF 400 or on a contact glass 32 of the scanner 300 after the ADF 400 is opened and then the ADF 400 is shut to press the original. When the start switch of the operation portion (not shown) is pressed, the scanner 300 is driven to travel a first moving body 33 and a second moving body 34 after the original is transferred to the contact glass 32 when the original is set on the ADF 400 or immediately in the case in which the original is set on the contact glass 32. The light source emits light and the first moving body 33 reflects the light reflected by the original to the second moving body 34. The light is further reflected at the mirror thereof to a reading sensor 36 through an image focus lens 35 to read the content of the original. Thereafter, in the case in which the mode is set at the operation portion or the automatic mode is selected at the operation portion, the image formation starts at the full color mode or the mono color mode according to the reading result of the original.

When the full color mode is selected, each of the photoreceptor drums 40Y, 40C, 40M and 40K rotates counterclockwise in FIG. 1. Respective charging rollers 2 corresponding to the photoreceptor drums 40Y, 40C, 40M and 40K uniformly charge the surface thereof. The photoreceptor drums 40Y, 40C, 40M and 40K are irradiated with respective laser beams L corresponding to each color image to form respective latent electrostatic images corresponding to each color image data. Each latent electrostatic image is developed with each color toner by the developing devices 60Y, 60C, 60M and 60K corresponding thereto as the photoreceptor drum 40Y, 40C, 40M and 40K rotate. Each color toner image is sequentially transferred to the surface of the intermediate transfer belt 10 and overlapped with each other to form a synthesized color toner image thereon. Each photoreceptor drum 40Y, 40C, 40M and 40K is optically discharged by each corresponding discharging lamp 72 after image transfer followed by cleaning by the cleaning device.

Along with the image formation, one of the paper feeding rollers 42 in the paper feeder table 200 is selected and rotated and sheets (recording medium) are sent out from one of paper feeder cassettes 44 multi-stacked in a paper feeder 43. A separation roller 45 separates and feeds the sheets one by one to a paper feeder path 46. A transfer roller 47 guides the separated sheet to a paper feeder path 48 in the main body 100 and the sheet is held at a registration roller 49. Alternatively, a paper feeder roller 50 is rotated to send out transfer material (sheet) on a manual feeder tray 51. The transfer material is separated and guided one by one to a manual paper feeder path 53 and also held at the registration roller 49. Thereafter, the registration roller 49 is rotated to feed the sheet to between the intermediate transfer belt 10 and the secondary transfer device 22 in synchronization with the synthesized color image on the intermediate transfer belt 10. The synthesized toner image is transferred to the sheet by the secondary transfer device 22. The sheet having the toner image thereon is transferred and fed by the secondary transfer device 22 to the fixing device 25, where the toner image is fixed upon application of heat and pressure. Thereafter, the sheet is switched by a switching claw 55, discharged by a discharging roller 56 and stacked on a discharging tray 57. Alternatively, the sheet is switched by the switching claw 55, fed into a sheet reverse device 28 where the sheet is reversed, and fed again to the transfer point to record an image on the reverse side of the sheet followed by discharging to the discharging tray 57 by the discharging roller 56. When image formation is instructed for more than one sheet, the image formation process described above is repeated.

When all the job is done, all the photoreceptor drums 40Y, 40M, 40C and 40K stop the rotation thereof after the image formation process is finished. After the image formation, the photoreceptor drums 40Y, 40M, 40C and 40K rotate at least one cycle while the discharging lamp 72 is kept in operation to discharge the charges thereon. Thereby, the photoreceptor drums 40Y, 40M, 40C and 40K are left discharged to prevent deterioration thereof.

When the monochrome mode is selected, the supporting roller 15 moves downward to separate the intermediate transfer belt 10 from the photoreceptor drums 40Y, 40M, and 40C. Thus, only the photoreceptor drum 40K is made in contact with the intermediate transfer belt 10. Only the photoreceptor drum 40K is rotated counterclockwise in FIG. 1 and the surface thereof is uniformly charged by the charging roller 2 so that a latent electrostatic image for black is formed. The latent electrostatic image is then developed with black toner. The toner image is transferred to the intermediate transfer belt 10. During this image formation, the photoreceptor drums 40Y, 40M, and 40C (other than the photoreceptor 40K) including the peripheral devices such as the developing devices are at rest. Therefore, the photoreceptor drums 40Y, 40M, and 40C are not abraded so that the unnecessary exhaustion thereof and unnecessary consumption of the developing agent can be avoided.

Along with this image formation, a sheet is fed from the paper feeder cassette 44 and transferred by the registration roller 49 in synchronization with the transfer of the toner image formed on the intermediate transfer belt. The toner image on the sheet is fixed by the fixing device 25 as in the full color mode. Thereafter, the sheet is discharged through the discharging system according to the selected mode. When image formation is instructed for more than one sheet, the image formation process described above is repeated.

Next, the charging device 70 is described in detail.

Figure 4:
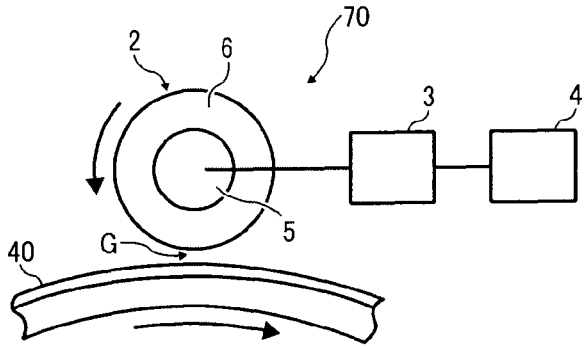
FIG. 4 is a diagram illustrating the structure of the charging device of the photoreceptor seen from the axis direction of the charging roller.

FIG. 4 is a schematic diagram illustrating the charging device 70 seen from the axis direction of the charging roller 2

Figure 5:
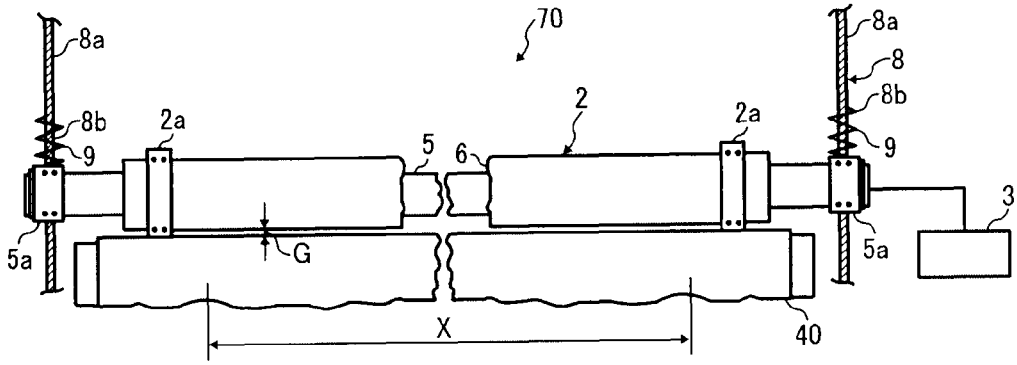
FIG. 5 is a diagram illustrating the structure of the charging device of the photoreceptor seen from an orthogonal direction to the axis of the charging roller.

FIG. 5 is a schematic diagram illustrating the charging device 70 seen from a direction orthogonal to the axis direction of the charging roller 2.

The charging device 70 includes a charging roller 2 (a charging member) located facing the surface of the photoreceptor drum 40 with a minute gap G therebetween, and a power supply 3 as a bias application device which applies a charging bias to the charging roller 2. The power supply 3 is controlled by a controller 4 as a charging bias control device.

The charging roller 2 is structured of a core metal 5 as an electroconductive substrate, a resin layer 6 as an electroconductive resin portion covering the core metal portion facing the surface of the photoreceptor drum 40, a gap holding member 2*a* as an insulation resin portion which maintains the gap G between the surface of the photoreceptor drum 40 and the resin layer 6 by contacting the surface of the photoreceptor drum 40, etc. Both ends of the core metal 5 of the charging roller 2 are rotatably supported by respective bearings 5*a*. Each bearing 5*a* is slidably fit into a hole (slot) 8*b* provided to a side plate 8*a* of a casing 8 of the charging device 70 in the attachment and detachment direction relative to the photoreceptor drum 40. Furthermore, the bearing 5*a* is pressed to the surface of the photoreceptor drum 40 by a compression spring 9. It is preferred that the pressure power of the compression spring 9 is a power by which the charging roller 2 is driven and rotated by the rotation drive of the photoreceptor drum 40 at substantially the same speed as that of the photoreceptor drum 40. Thus, the gap holding member 2*a* is in contact with the surface of the photoreceptor drum 40 under a particular pressure so that the charging roller 2 can suitably rotate with the photoreceptor drum 40. In addition, the gap G is possibly maintained with good precision. Furthermore, the power supply 3 is electrically connected to the core metal 5 of the charging roller 2, to which a particular charging bias is applied. Thereby, discharging occurs at the gap G between the charging roller 2 and the surface of the photoreceptor drum 40 so that at least an image formation area X of the photoreceptor drum 40 is charged with a particular polarity. In the case in which the photoreceptor drum 40 and the charging roller 2 are provided in the vicinity of each other, it is preferred to adopt an AC application system applying a charging bias in which an AC voltage is overlapped with a DC voltage as the charging bias application system to uniformly charge the surface of the photoreceptor drum 40. Thus, the AC application system is adopted in this embodiment.

The core metal 5 is made of metal such as stainless metal. When the core metal 5 is too thin, an adverse impact by the flexure caused during cutting processing or upon an application of pressure easily reaches an ignorable degree so that a preferred gap precision is not obtained. When the core metal 5 is too thick, the charging roller 2 increases in its size and weight. Therefore, a suitable diameter of the core metal 5 is from about 6 to about 10 mm.

The resin layer 6 is preferably made of a material having a volume resistance of from $10^4$ to $10^9 \Omega \cdot cm$. When the volume resistance thereof is too small, the charging bias easily leaks when the photoreceptor drum 40 has a defect such as a pinhole. When the volume resistance is too high, the photoreceptor drum 40 tends to be not uniformly charged because of insufficient discharging. The volume resistance of the resin layer 6 can be adjusted by adding an electroconductive material to the basic resin. Specific examples of such resins include resins of polyethylene, polypropylene, methyl polymethacrylate, polystyrene, copolymers of acrylonitrile-butadiene-styrene and polycarbonate. These basic resins have a good moldability and are easy to mold. Specific examples of such electroconductive material include ion conductive materials such as polymers having a tertiary ammonium base. Specific examples of polyolefins having a tertiary ammonium base include polyethylene, polypropylene, polybutane, polyisoplene, copolymers of ethylene, ethylacrylate, copolymers of ethylene and methylacrylate, copolymers of ethylene and vinyl acetate, copolymers of ethylene and propylene, and copolymers of ethylene and hexane having a tertiary ammonium base. In this embodiment, polyolefins having a tertiary ammonium base are illustrated but polymers having a tertiary ammonium base other than the polyolefins can be also used.

The ion conductive materials are uniformly dispersed in the basic resin by using a two axis kneading machine, etc. The material uniformly dispersed is easily molded to have a roller form by injection-molding or extraction-molding the material to the core metal. The mixing ratio of the ion conductive material and the basic resin is preferably from 30 to 80 parts by weight of the ion conductive material based on 100 parts by weight of the basic resin. The thickness of the resin layer 6 of the charging roller 2 is preferably from 0.5 to 3 mm. A resin layer 6 that is too thin may make molding difficult and cause a strength problem. When the resin layer 6 is too thick, the charging roller is inevitably large in size and the actual resistance of the resin layer 6 increases, resulting in deterioration of the charging efficiency.

After the resin layer 6 is molded, the gap holding member 2*a* which is preliminarily molded is press-fit and/or attached to both ends of the resin layer 6. The thus integrally fixed and united charging roller 2 and gap holding member 2*a* are subject to processing such as cutting or grinding to adjust the outer diameter of the charging roller 2. The variance of the resin layer 6 and the gap holding member 2*a* is prevented so that the variance of the gap G can be reduced.

The same basic resin for use in the resin layer 6, which are polyethylene, polypropylene, methyl polymethacrylate, polystyrene, copolymers of acrylonitrile-butadiene-styrene and polycarbonate resins, can be used as the material for the gap holding member 2*a*. However, since the gap holding member 2*a* is made in contact with the surface of the photoreceptor drum 40, it is preferred to use a resin softer than that for use in the resin layer 6 to avoid damage to the surface of the photoreceptor 40. As resin material having excellent slidability and which hardly damages the surface of the photoreceptor drum 40, there can be also used polyacetal, copolymers of ethylene and ethyl acrylate, polyvinylidene fluoride, copolymers of tetrafluoroethylene and perfluoroalkyl vinyl ether, and copolymers of tetrafluoroethylene and hexafluoropropylene.

In addition, a surface layer having a thickness of about several tens μm which hardly attracts toner, etc. can be formed on the resin layer 6 and/or the gap holding member 2*a* by a coating method.

The gap G is formed between the resin layer 6 of the charging roller 2 and the surface of the photoreceptor drum 40 by contacting the gap holding member 2*a* with the photoreceptor drum 40 outside the image formation area. A gear (not shown) of the charging roller 2 provided at the end of the core metal 5 is engaged with a gear provided to the flange of the photoreceptor drum 40. When the photoreceptor drum 40 is rotated by a photoreceptor driving motor (not shown), the charging roller 2 rotates at a substantially same linear speed as that of the photoreceptor drum 40 in the direction in which the charging roller 2 is driven by the photoreceptor drum 40. When a hard material is used for the resin layer 6 of the charging roller 2 and an organic photoreceptor is used as the photoreceptor drum 40, the photosensitive layer in the image area is not damaged since the resin layer and the surface of the photoreceptor drum 40 are not in contact with each other. When the gap G is too wide, abnormal discharging occurs and the surface of the photoreceptor rum 40 is not uniformly charged. Therefore, the gap is about 100 μm at maximum.

Figure 6:
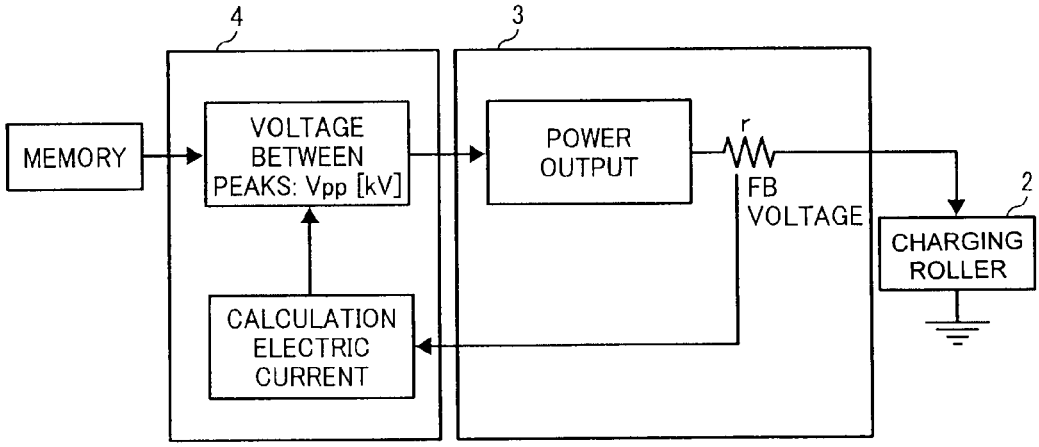
FIG. 6 is a block chart illustrating the function of the power supply and the controller of the charging device of the photoreceptor.

FIG. 6 is a block diagram illustrating the function of the power supply 3 and the controller 4.

The controller 4 in this embodiment is a control portion to control the image formation behavior in the image forming apparatus overall but also can be a controller dedicated to control the power supply of the charging device 70.

The controller 4 follows the instruction from the operation unit (not shown) or the results detected with regard to the kind of the original, etc. when the automatic mode is selected at the operation unit, and makes controls over image formation at the image formation speed in a low speed mode or a high speed mode. Specifically, when the controller 4 functioning as an image formation speed switching device receives an instruction from the operation unit or a switching signal about the image formation speed resulting from the detection with regard to the kind of the original, etc., the controller 4 determines that a particular switching condition is satisfied and then switches the image formation speed from the low mode to the high mode or vice versa. When a thick sheet is used, the controller 4 switches the image formation speed to the low speed mode and controls the photoreceptor drum motor such that that the linear speed of the photoreceptor drum 40 is 175 mm/s. When a plain sheet is used, the controller 4 switches the image formation speed to the high speed mode and controls the photoreceptor drum motor such that that the linear speed of the photoreceptor drum 40 is 280 mm/s. These image formation speeds are just for illustration only and not limiting. In this embodiment, the number of image formation speeds is two but the same applies to a case in which three or more image formation speeds are used.

The gap G between the charging roller 2 and the photoreceptor drum 4 varies cyclically or randomly depending on the eccentricity of the charging roller 2 and the photoreceptor drum 40 and the vibration during image formation. Therefore, in the case of a DC application system in which only a DC voltage is applied to the charging roller 2, uneven density in the toner image formed on the photoreceptor 40 inevitably occurs. The power supply 3 of the charging device 70 in this embodiment adopts an AC application system using a charging bias in which a peak to peak AC voltage is constant voltage controlled and overlapped to a constant voltage controlled DC. Therefore, when the gap G varies, the surface voltage of the photoreceptor drum 40 after charging is maintained substantially the same. With regard to the AC application system, there are two application methods. In one method, a constant current controlled AC voltage overlapped with a constant voltage controlled DC voltage is applied to the charging roller 2. In the other method, a constant voltage controlled AC voltage overlapped with a constant voltage controlled DC voltage is applied to the charging roller 2.

In this embodiment, a memory as the storage device stores set values about the charging bias such as DC voltage value, AC voltage value (peak to peak value VPP), AC voltage frequency and target charging current value for each image formation operation. The summary of what is stored in the memory is as shown in Table 1. The DC voltage is a value suitably varied according to the development ability.

TABLE 1

| Image formation speed (mm/s) | DC voltage value (kV) | Peak to peak Voltage (kV) | AC voltage frequency (Hz) | Target value of charging electric current (mA) |
|---|---|---|---|---|
| 175 | Fixed | Variable | 1,250 | 1.35 |
| 280 | Fixed | Variable | 2,000 | 1.85 |

When images are formed, the controller 4 reads the set values corresponding to the image formation speed from the memory and outputs a control instruction of the charging bias to the power supply 3 based on the read set values. The power supply 3 outputs a charging bias from a power output unit to the charging roller 2 according to the control instruction. The power supply 3 includes a minute fixed resistance r forming an electric current detection device. The voltage applied to both ends of the minute fixed resistance r is measured and an AC current value (effective value) Icac flown through the charging roller 2 is voltage-converted as a feed back voltage value (FB value). The power supply 3 outputs the FB value. The controller 4 functions as an AC voltage adjustment device, and generates and outputs a new control instruction to the power supply 3 in which the peak to peak voltage Vpp is changed such that AC current value represented by the FB value approaches the charging current target read from the memory. The power supply 3 follows the new control instruction and outputs a charging bias in which the peak to peak voltage Vpp is adjusted from the voltage output unit to the charging roller 2.

In addition, the controller 4 changes the peak to peak voltage Vpp which is stored in the memory before the set value change to the peak to peak voltage Vpp after the set value change. In addition to this change, the controller 4 also changes the peak to peak voltage Vpp corresponding to the other image formation speed. In this embodiment, the peak to peak voltage Vpp optimized for one image formation speed is also optimal for the other image formation speed. To be specific, the charging current target for each image formation speed in this embodiment is set based on the experiments conducted beforehand such that the peak to peak voltages Vpp optimized at each image formation speed are substantially the same.

Figure 7:
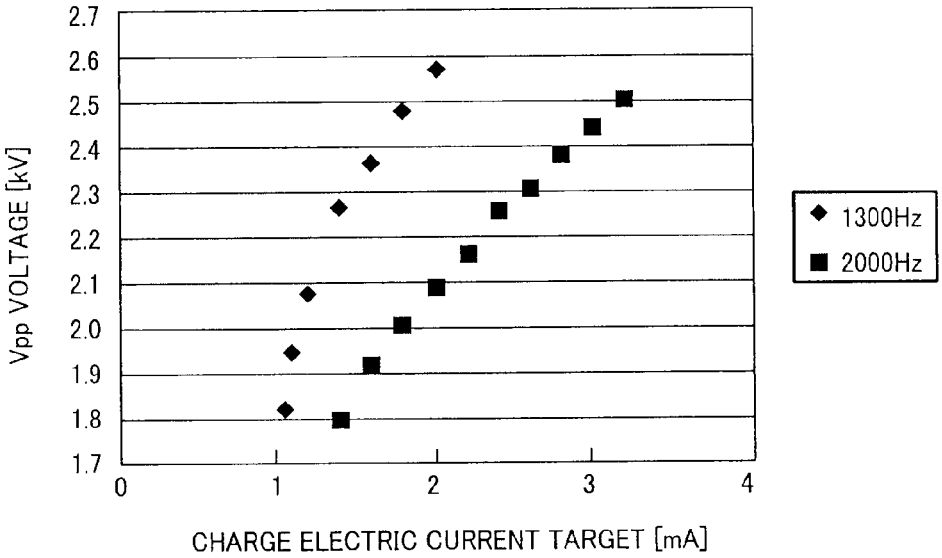
FIG. 7 is a graph illustrating the result of adjustment of the peak to peak voltage Vpp when a charging bias having two kinds of AC voltage frequencies for the same information speed is applied and adjusted under a particular charging condition to vary the charging current target.

FIG. 7 is a graph illustrating the adjustment results of the peak to peak voltage Vpp when charging biases are applied at two kinds of AC voltage frequency (1,300 Hz and 2,000 Hz) for one image formation speed and adjusted under a particular charging condition while the charging current target is varied.

As seen in the graph, when the charging current targets are the same but the AC voltage frequencies of the charging bias are different from each other, the adjustment results of the peak to peak voltage Vpp are different.

Table 2 shows the evaluation result when the set values of the peak to peak voltage Vpp are varied in this embodiment. This evaluation is made with regard to the image quality of half tone images formed at image formation speed of 175 mm/s and 280 mm/s under the same condition. The criteria of the evaluation are as follows:

G (Good): when uniform quality image is obtained

I (Inferior): when abnormal image having whiteout and black spots is obtained due to the shortage of bias B (Bad): when abnormal image is obtained with uneven density corresponding to charging roller pitch

TABLE 2

| | Vpp (kV) | | | | | | |
|---|---|---|---|---|---|---|---|
| | 1.8 | 1.9 | 2.0 | 2.1 | 2.2 | 2.3 | 2.4 |
| 175 mm/s | B | B | I | G | G | G | G |
| 280 mm/s | B | B | I | G | G | G | G |

As illustrated in FIG. 2, when the set values of the peak to peak voltage Vpp are varied in this embodiment, the peak to peak voltage Vpp and the evaluation result have a relationship with regard to each image formation speed in which charging biases having different AC voltage frequency are used. That is, at each image formation speed, the evaluation result is good when the peak to peak voltage Vpp is 2.1 (kV) or higher, the evaluation result is inferior when the peak to peak voltage Vpp is 2.0 (kV), and the evaluation result is bad when the peak to peak voltage Vpp is 1.9 (kV) or lower.

In this embodiment, the same image quality is obtained with the same peak to peak voltage Vpp irrespective of the difference in the AC voltage frequencies. Therefore, when charging biases having a different AC frequency are used for each image formation speed, it is possible to use the optimal peak to peak voltage Vpp obtained after the charging bias adjustment for one image formation speed as the optimal peak to peak voltage Vpp for the other image formation speed by setting the charging current target for each image formation speed as in this embodiment. For example, when a charging bias is adjusted during image formation at the low speed mode (175 mm/s) and the result of the adjustment of the peak to peak voltage Vpp is 2.1 (kV) and the next image formation is performed at the low speed mode, a charging bias having a voltage frequency of 1,250 Hz and a peak to peak voltage Vpp of 2.1 kV is output. When the next image formation is performed at the high speed mode (280 mm/s), a charging bias having a voltage frequency of 2,000 Hz and a peak to peak voltage Vpp of 2.1 kV is output.

In this embodiment, the AC voltage frequency is set for each image formation speed to satisfy the following relationship: $6<f/V<9$, where f represents the AC voltage frequency (Hz) of the charging bias and V represents the image formation speed (mm/s). To be specific, in this embodiment, the AC voltage frequency for each image formation speed is set such that f/V is 7.14. Therefore, uneven density having a stripe form or filming on the surface of the photoreceptor drum 40 does not easily occur when images are formed at either of the image formation speeds.

The timing of adjusting the charging bias is suitably determined, for example, every 10 images. It is also preferred to adjust the charging bias when the power is on. In these cases, it is not necessary to adjust the charging bias for each image formation speed but only for a representative image formation speed. The thus obtained optimal peak to peak voltage Vpp is set as the optimal peak to peak voltage Vpp for each image formation speed.

As described above, according to this embodiment, the waiting time to be taken for the charging bias adjustment does not increase even for an image forming apparatus which can form images at different image formation speeds. Therefore, the time interval taken between each charging bias adjustment is narrowed so that it is possible to adjust to the environment change and/or the temperature change in the apparatus quickly.

In addition, when the charging bias is adjusted when the power is on, the waiting time to be taken for the charging bias adjustment does not increase so that the first print output time does not increase even for an image forming apparatus which can form images at different image formation speeds.

As described above, by adjusting the peak to peak voltage Vpp such that the current flown through the charging roller 2 approaches the charging current target, the impact of the resistance variance of the charging roller 2 is cancelled when the temperature or the environment changes. Therefore, the suitable charging bias treatment is maintained. However, depending on the material for use in the charging roller 2, the thickness of the resin layer 6 and/or the thickness and the hardness of the gap holding member 2*a* vary according to the environment change so that the gap G varies. In this case, a temperature and humidity sensor is provided in an image forming apparatus as the environment information device so that the charging current target can be set according to the environment. Table 3 shows one example thereof. In Table 3, the environment is separated into three of low temperature and low humidity, room temperature and normal humidity and high temperature and high humidity but can be divided furthermore.

TABLE 3

| Image formation speed (mm/s) | AC voltage frequency (Hz) | Current target (mA) | | |
|---|---|---|---|---|
| | | low temperature and low humidity | room temperature and normal humidity | high temperature and high humidity |
| 175 | 1,250 | 1.45 | 1.35 | 1.25 |
| 280 | 2,000 | 1.9 | 1.85 | 1.8 |

In addition, a tandem type image forming apparatus is used in this embodiment as described above. In such an image forming apparatus, the length of the high voltage cable to the charging roller 2 of each image formation unit 18Y, 18C, 18M and 18K are different from each other in some cases to deal with a request based on the layout. In general, the loss of the AC voltage varies depending on the length of the high voltage cable. In such a case, the charging current target is preferably set for each image formation unit 18Y, 18C, 18M and 18K separately. Furthermore, it is possible to set the charging current target for each image formation unit in combination with the individual setting of the charging current targets according to the environment change.

With regard to the method of detecting the electric current flown through the charging roller 2, it is typical to detect the output current from the electric supply 3 as described above. However, in a structure in which a detection device is provided to detect the electric current flown into the photoreceptor drum 40, the impact of the loss caused by the difference between the lengths of the high voltage cable is reduced.

Next, Comparative Examples of the present invention are described below.

COMPARATIVE EXAMPLE 1

Table 4 shows the AC voltage frequency f, the charging current target and f/V for each image formation speed V.

TABLE 4

| Image formation speed V (mm/s) | AC voltage frequency f (Hz) | Charging current target (mA) | f/V |
|---|---|---|---|
| 175 | 1,900 | 1.85 | 10.86 |
| 280 | 1,900 | 1.85 | 6.79 |

In Comparative Example 1, a durability test is performed for each image formation speed and initially quality images are obtained at each image formation speed. With regard to the low speed mode (175 mm/s), toner filming occurs on the surface of the photoreceptor 40 over time, which degrades the quality of images. This is considered to be because the AC voltage frequency is excessively high for the low speed mode (175 mm/s).

COMPARATIVE EXAMPLE 2

Table 5 shows the AC voltage frequency f, the charging current target and f/V for each image formation speed V.

TABLE 5

| Image formation speed V (mm/s) | AC voltage frequency f (Hz) | Charging current target (mA) | f/V |
|---|---|---|---|
| 175 | 1,300 | 1.35 | 7.43 |
| 280 | 1,300 | 1.35 | 4.64 |

In Comparative Example 2, the image quality is evaluated for half tone images output at each image formation speed. The quality image is good for the low speed mode (175 mm/s) but striped uneven density occurs at the high speed mode (280 mm/s) from the beginning. This is considered to be because the AC voltage frequency is short for the image formation speed.

COMPARATIVE EXAMPLE 3

In Table 6, the AC voltage frequency f, the charging current target and f/V for each image formation speed V are shown.

TABLE 6

| Image formation speed V (mm/s) | AC voltage frequency f (Hz) | Charging current target (mA) | f/V |
|---|---|---|---|
| 175 | 1,300 | 1.35 | 7.43 |
| 280 | 1,900 | 1.35 | 6.79 |

In Comparative Example 3, when the charging bias is adjusted at the low speed mode (175 mm/s), the image quality is good with an optimal peak to peak voltage Vpp of 2.1 kV. However, when the charging bias is adjusted at the high speed mode (280 mm/s), the optimal peak to peak voltage Vpp is adjusted to 1.8 kV or lower so that the uneven density occurs. This is thought to be because the charging current target is not suitable for the high speed mode (280 mm/s).

COMPARATIVE EXAMPLE 4

Table 7 shows the AC voltage frequency f, the charging current target and f/V for each image formation speed V.

TABLE 7

| Image formation speed V (mm/s) | AC voltage frequency f (Hz) | Charging current target (mA) | f/V |
|---|---|---|---|
| 175 | 1,300 | 1.85 | 7.43 |
| 280 | 1,900 | 1.85 | 6.79 |

In Comparative Example 4, when the charging bias is adjusted at the high speed mode (280 mm/s), the image quality is good with an optimal peak to peak voltage Vpp of 2.1 kV. However, when the charging bias is adjusted at the low speed mode (175 mm/s), the optimal peak to peak voltage Vpp is adjusted to 2.5 kV or higher and initially there is no problem with the image quality. But toner filming occurs on the surface of the photoreceptor 40 over time, which degrades the quality of images. This is considered to be because the charging current target is too large, which causes excessive discharging.

The photocopier as the image forming apparatus related to the embodiment of the present invention includes the following: the photoreceptor drum 40 as an image bearing member the surface of which travels; the charging device 70 which uniformly charges the surface of the photoreceptor drum 40 by applying a charging bias in which an AC voltage is overlapped to a DC voltage to the charging roller 2 provided facing the surface of the photoreceptor drum 40; the irradiation device 21 and the developing device 60 as a toner image formation device to form a toner image on the surface of the photoreceptor drum 40 uniformly charged by the charging device 70; the intermediate transfer belt 10 and the secondary transfer device 22 as a transfer device which transfers the toner image formed on the surface of the photoreceptor drum 40 to a sheet as a recording medium; the fixing device 25 as a fixing device which fixes the toner image on the sheet; and the controller 4 as an image formation speed switching device which switches to one of the multiple image formation speeds (at the high speed mode or the low speed mode) by changing the surface travel speed of the photoreceptor drum 40 according to a particular switching condition.

This photoreceptor further includes the following: a memory as a storage device to store the charging current target of the charging bias to be applied to the charging roller 2 for each image formation speed; a power supply 3 including the minute fixed resistance r as the current detection device to detect the electric current flown through the charging roller 2; and the controller 4 as an AC voltage adjustment device to adjust the peak to peak voltage Vpp, which is the AC voltage of the charging bias to be applied, such that the electric current value detected by the power supply 3 approaches the charging current target stored in the memory which corresponds to the image formation speed at the time of electric current detection. The photocopier sets the charging current values corresponding to the high speed mode and the low speed mode described above such that the peak to peak voltages Vpp adjusted by the controller 4 are substantially the same with regard to the high speed mode and the low speed mode. Therefore, in an image forming apparatus which forms images by switching the image formation speed, the time to be taken for adjusting the charging bias is reduced in comparison with the case in which the charging bias is adjusted for each image formation speed. Thus, increasing the waiting time is avoidable.

Especially, in this embodiment, the electric current flown through the charging roller 2 is detected during image formation and the controller 4 adjusts the peak to peak voltage Vpp of the charging bias to be applied to the charging roller 2 during image formation. Therefore, it does not take a time to adjust the charging bias.

In addition, in this embodiment, the AC voltage frequency is set for each image formation speed to satisfy the following relationship: $6<f/V<9$, where f represents the AC voltage frequency (Hz) of the charging bias and V represents the image formation speed (mm/s). Therefore, striped uneven density or filming on the surface of the photoreceptor drum 40 does not occur.

Furthermore, in this embodiment, as described above, it is possible to provide a temperature and humidity detection sensor as a detection device by which the temperature and the humidity as the environment information inside or around the photocopier are detected. In that structure, multiple charging current targets corresponding to each of multiple pieces of environment information (for example, for low temperature, room temperature and normal humidity, and high temperature and high humidity) for each of multiple image formation speed are stored in the memory. The controller 4 can be set to adjust the peak to peak voltage Vpp of the charging bias to be applied to the charging roller 2 such that the detected electric current approaches the charging current target corresponding to the environment information detected by the temperature and humidity sensor among the multiple charging current targets corresponding to the image formation speed at the time of the detection. In this case, it is possible to maintain a suitable charging bias even when the optimal bias changes due to the variance of the gap G caused by environment change.

Also, the photoreceptor of this embodiment includes multiple photoreceptor drums 40, respective charging devices 70 and toner image formation devices. The transfer device is to transfer the overlapped image of the toner images formed on the surface of each of the photoreceptor drums 40 to a sheet. In this structure, it is suitable to store the AC voltage frequency and the charging current target for each of the multiple image formation speeds for each charging device 70. Therefore, the impact caused by the difference in the lengths of the cables from the power supply 3 to the respective charging rollers 2 can be cancelled so that a suitable charging bias can be obtained for each charging device 70.

In addition, in the embodiment, since the charging roller 2 is provided in the vicinity of the surface of the photoreceptor drum 40, it is less likely that foreign material such as toner is attached to the charging roller 2 in comparison with a structure in which the charging roller 2 is provided in contact with the surface of the photoreceptor drum 40.

Especially, the charging roller 2 of this embodiment includes the core metal 5 as an electroconductive substrate, the resin layer 6 as an electroconductive resin portion to cover the core metal 5 facing the surface of the photoreceptor drum 40, and the gap holding member **2*a* as an insulation resin portion which contacts the surface of the photoreceptor drum 40 to maintain the gap G between the surface of the photoreceptor 40 and the resin layer 6**. Therefore, the gap G is stably secured so that stable charging treatment is enabled.

Furthermore, in this embodiment, an organic photoreceptor having a protective layer on the surface thereof can be used as the photoreceptor drum 40, which leads to reduction of the abrasion amount of the photoreceptor drum 40 and extension of working life thereof.

Furthermore, since this embodiment includes the brush roller 74 and the solid lubricant 78 as a lubricant supply device to supply a lubricant to the surface of the photoreceptor drum 40, the abrasion of the photoreceptor drum 40 is reduced and the working life thereof is extended even for an AC application system.

In addition, at least the photoreceptor drum 40, the charging device 70 and the memory can be integrally structured as a process cartridge, which is detachably attachable to the main body of the photocopier of this embodiment.

This document claims priority and contains subject matter related to Japanese Patent Application No. 2007-152260 filed on Jun. 8, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an image bearing member including a travelling moving surface;

a charging device comprising a charging member facing the moving surface of the image bearing member, the charging device uniformly charging the moving surface of the image bearing member to form a latent electrostatic image thereon by applying a charging bias in which an AC voltage is overlapped with a DC voltage to the charging member;

a developing device that develops the latent electrostatic image with toner to form a toner image on the moving surface of the image bearing member;

a transfer device that transfers the toner image on the moving surface of the image bearing member to a recording medium;

a fixing device that fixes the toner image on the recording medium;

an image formation speed switching device that switches from one image formation speed to another image formation speed among multiple image formation speeds by changing a surface traveling speed of the image bearing member according to a particular switching condition;

a storage device that stores a charging current target of the charging bias applied to the charging member for each of the multiple image formation speeds;

an electric current detection device that detects an electric current flown through the charging member; and an AC voltage adjustment device that adjusts an AC voltage of the charging bias applied to the charging member such that the electric current detected by the electric current detection device corresponds to the charging current target of the image formation speed, wherein with regard to at least two image formation speeds among the multiple image formation speeds, the charging current target is set for each of the at least two image formation speeds such that each AC voltage adjusted by the AC voltage adjustment device is substantially the same.

2. The image forming apparatus according to claim 1, wherein the electric current detection device detects an electric current flowing through the charging member during image formation, and the AC voltage adjustment device adjusts an AC voltage of the charging bias applied to the charging member during image formation.

3. The image forming apparatus according to claim 1, wherein an AC voltage frequency f (Hz) of the charging bias and the image formation speed V (mm/s) satisfy the following relationship: $6<f/V<9$.

4. The image forming apparatus according to claim 1, further comprising:

an environment information detection device that detects environment information inside or around the image forming apparatus, wherein the storage device stores multiple charging current targets corresponding to multiple pieces of environment information for each of the multiple image formation speeds, and the AC voltage adjustment device adjusts the AC voltage of the charging bias applied to the charging member such that the electric current detected by the electric current detection device approaches the charging current target which corresponds to the environment information detected by the environment information detection device among multiple charging current targets which correspond to the image formation speed when the electric current is detected.

5. The image forming apparatus according to claim 1, wherein the charging member has a roller form and is located in a vicinity of the surface of the image bearing member.

6. The image forming apparatus according to claim 5, wherein the charging member comprises an electroconductive supporting member, an electroconductive resin portion which covers a portion of the electroconductive supporting member which faces the moving surface of the image bearing member, and an insulation resin portion which contacts the moving surface of the image bearing member to maintain a gap between the moving surface of the image bearing member and the electroconductive resin portion.

7. The image forming apparatus according to claim 1, wherein the image bearing member is an organic photoreceptor comprising a protective layer on the moving surface thereof.

8. The image forming apparatus according to claim 1, further comprising a lubricant supply device that supplies a lubricant to the moving surface of the image bearing member.

9. A process cartridge detachably attachable to a main body of the image forming apparatus of claim 1, the process cartridge comprising:

the image bearing member of claim 1;

the charging device of claim 1; and the storage device of claim 1.

10. The image forming apparatus according to claim 1, wherein the storage device stores an AC voltage frequency for each of the multiple image formation speeds.

11. The image forming apparatus according to claim 1, wherein with regard to the at least two image formation speeds among the multiple image formation speeds, the charging current target is set for each of the at least two image formation speeds such that a peak to peak voltage of the AC voltage is substantially the same.

12. A method of forming images comprising:

charging a moving surface of an image bearing member with a charging device comprising a charging member facing the moving surface of the image bearing member, the charging device uniformly charging the moving surface of the image bearing member to form a latent electrostatic image thereon by applying a charging bias in which an AC voltage is overlapped with a DC voltage to the charging member;

irradiating the moving surface of the image bearing member to form a latent electrostatic image thereon;

developing the latent electrostatic image with toner to form a toner image on the moving surface of the image bearing member with a developing device;

transferring the toner image on the moving surface of the image bearing member to a recording medium with a transfer device;

fixing the toner image on the recording medium with a fixing device;

switching from one image formation speed to another image formation speed among multiple image formation speeds by changing a surface traveling speed of the image bearing member according to a particular switching condition with an image formation speed switching device;

storing a charging current target of the charging bias applied to the charging member for each of the multiple image formation speeds by a storage device;

detecting an electric current flown through the charging member with an electric current detection device; and adjusting an AC voltage of the charging bias applied to the charging member with an AC voltage adjustment device such that the electric current detected by the electric current detection device corresponds to the charging current target of the image formation speed, wherein with regard to at least two image formation speeds among the multiple image formation speeds, the charging current target is set for each of the at least two image formation speeds such that each AC voltage adjusted by the AC voltage adjustment device is substantially the same.

13. The method of forming images according to claim 12, wherein the electric current detection device detects an electric current flowing in the charging member during image formation, and the AC voltage adjustment device adjusts an AC voltage of the charging bias applied to the charging member during image formation.

14. The method of forming images according to claim 12, wherein an AC voltage frequency f (Hz) of the charging bias and the image formation speed V (mm/s) satisfy the following relationship: $6<f/V<9$.

15. The method of forming images according to claim 12, further comprising:

detecting environment information inside or around the image forming apparatus with an environment information detection device, wherein the storage device stores multiple charging current targets corresponding to multiple pieces of environment information for each of the multiple image formation speeds, and the AC voltage adjustment device adjusts the AC voltage of the charging bias applied to the charging member such that the electric current detected by the electric current detection device approaches the charging current target which corresponds to the environment information detected by the environment information detection device among multiple charging current targets which correspond to the image formation speed when the electric current is detected.

16. The method of forming images according to claim 12, wherein the charging member has a roller form and is located in a vicinity of the surface of the image bearing member.

17. The method of forming images according to claim 16, wherein the charging member comprises an electroconductive supporting member, an electroconductive resin portion which covers a portion of the electroconductive supporting member which faces the moving surface of the image bearing member, and an insulation resin portion which contacts the moving surface of the image bearing member to maintain a gap between the moving surface of the image bearing member and the electroconductive resin portion.

18. The method of forming images according to claim 12, wherein the image bearing member is an organic photoreceptor comprising a protective layer on the moving surface thereof.

19. The method of forming images according to claim 12, further comprising supplying a lubricant to the moving surface of the image bearing member with a lubricant supply device.

20. The method of forming images according to claim 12, wherein with regard to the at least two image formation speeds among the multiple image formation speeds, the charging current target is set for each of the at least two image formation speeds such that a peak to peak voltage of the AC voltage is substantially the same.

* * * * *